US010283103B2

(12) United States Patent
Kumar

(10) Patent No.: US 10,283,103 B2
(45) Date of Patent: May 7, 2019

(54) REAL-TIME ACOUSTIC PROCESSOR

(71) Applicant: Avnera Corporation, Beaverton, OR (US)

(72) Inventor: Amit Kumar, Portland, OR (US)

(73) Assignee: AVNERA CORPORATION, Beaverton, OR (US)

( * ) Notice: Subject to any disclaimer, the term of this patent is extended or adjusted under 35 U.S.C. 154(b) by 0 days.

(21) Appl. No.: 15/916,885

(22) Filed: Mar. 9, 2018

(65) Prior Publication Data

US 2018/0261199 A1 Sep. 13, 2018

Related U.S. Application Data

(60) Provisional application No. 62/469,461, filed on Mar. 9, 2017.

(51) Int. Cl.
*G10K 11/175* (2006.01)
*G10K 11/178* (2006.01)

(52) U.S. Cl.
CPC ..... *G10K 11/175* (2013.01); *G10K 11/17823* (2018.01); *G10K 11/17827* (2018.01); *G10K 11/17837* (2018.01); *G10K 11/17854* (2018.01); *G10K 11/17855* (2018.01); *G10K 11/17875* (2018.01); *G10K 2210/1081* (2013.01); *G10K 2210/12* (2013.01); *G10K 2210/128* (2013.01); *G10K 2210/3011* (2013.01); *G10K 2210/3017* (2013.01); *G10K 2210/3026* (2013.01); *G10K 2210/3028* (2013.01); *G10K 2210/3031* (2013.01); *G10K 2210/3039* (2013.01); *G10K 2210/3055* (2013.01)

(58) Field of Classification Search
CPC ..... G10K 11/175; G10K 2210/3028; G10K 2210/3031; H04R 1/1083; H04R 2460/01
USPC ..... 381/71.2, 71.1, 73.1, 94.1
See application file for complete search history.

(56) References Cited

U.S. PATENT DOCUMENTS 5,444,786 A 8/1995 Raviv
8,090,114 B2 1/2012 Burge et al.
(Continued)

FOREIGN PATENT DOCUMENTS

EP 2223855 A1 9/2010
EP 2452335 A1 5/2012
(Continued)

OTHER PUBLICATIONS

International Search Report and Written Opinion of the International Search Authority from International Application No. PCT/US2018/021748, dated Aug. 20, 2018, 23 pages.

*Primary Examiner* — Ahmad F. Matar
*Assistant Examiner* — Sabrina Diaz
(74) *Attorney, Agent, or Firm* — Miller Nash Graham & Dunn LLP

(57) ABSTRACT

The disclosure includes an acoustic processing network comprising a Digital Signal Processor (DSP) operating at a first frequency and a Real-Time Acoustic Processor (RAP) operating at a second frequency higher than the first frequency. The DSP receives a noise signal from at least one microphone. The DSP then generates a noise filter based on the noise signal. The RAP receives the noise signal from the microphone and the noise filter from the DSP. The RAP then generates an anti-noise signal based on the noise signal and the noise filter for use in Active Noise Cancellation (ANC).

18 Claims, 10 Drawing Sheets

(56) References Cited

U.S. PATENT DOCUMENTS

| | | | | |
|---|---|---|---|---|
| 8,848,935 | B1 | 9/2014 | Massie et al. | |
| 9,894,438 | B2 | 2/2018 | Kumar et al. | |
| 2009/0034748 | A1 | 2/2009 | Sibbald | |
| 2010/0272275 | A1 | 10/2010 | Carreras et al. | |
| 2010/0310086 | A1* | 12/2010 | Magrath | G10K 11/178 381/71.11 |
| 2011/0001646 | A1 | 1/2011 | Koch | |
| 2011/0007907 | A1 | 1/2011 | Park et al. | |
| 2011/0243343 | A1* | 10/2011 | Gauger, Jr. | G10L 21/0208 381/71.6 |
| 2012/0308025 | A1 | 12/2012 | Hendrix et al. | |
| 2014/0086425 | A1* | 3/2014 | Jensen | G10K 11/17854 381/71.11 |
| 2014/0112491 | A1 | 4/2014 | Murthy et al. | |
| 2014/0270223 | A1 | 9/2014 | Li et al. | |
| 2015/0163592 | A1 | 6/2015 | Alderson | |

FOREIGN PATENT DOCUMENTS

| | | | |
|---|---|---|---|
| GB | 2455828 | A | 6/2009 |
| WO | 2012166273 | A2 | 12/2012 |

* cited by examiner

REAL-TIME ACOUSTIC PROCESSOR

CROSS-REFERENCES TO RELATED APPLICATIONS

The present application claims benefit from U.S. Provisional Patent Application Ser. No. 62/469,461, filed Mar. 9, 2017, and entitled "Real-Time Acoustic Processor," which is incorporated herein by reference as if reproduced in its entirety.

BACKGROUND

Active noise cancellation (ANC) may be employed to reduce the amount of ambient noise a user hears when wearing headphones. In ANC, a noise signal is measured and a corresponding an anti-noise signal is produced. The anti-noise signal is an approximation of an inverse signal to the noise signal. The noise signal and the anti-noise signal destructively interfere, which may result in some or all of the ambient noise being removed from the user's ear. Generating an accurate anti-noise signal for high quality ANC requires that the corresponding system react quickly to changes in ambient noise. Latency is detrimental to ANC, because failure to react quickly can result in noise that is not properly canceled out. Further, failure of correction circuits to react quickly may result in erroneous noise amplification, bursts of anti-noise that does not cancel out the noise signal, etc. ANC may be further complicated when music is introduced to the headphones. In some cases, ANC may also be unable to distinguish noise from low frequency music. This may result in erroneous removal of the music signal along with the noise signal.

BRIEF DESCRIPTION OF THE DRAWINGS

Aspects, features and advantages of embodiments of the present disclosure will become apparent from the following description of embodiments in reference to the appended drawings in which.

DETAILED DESCRIPTION

Figure 1:
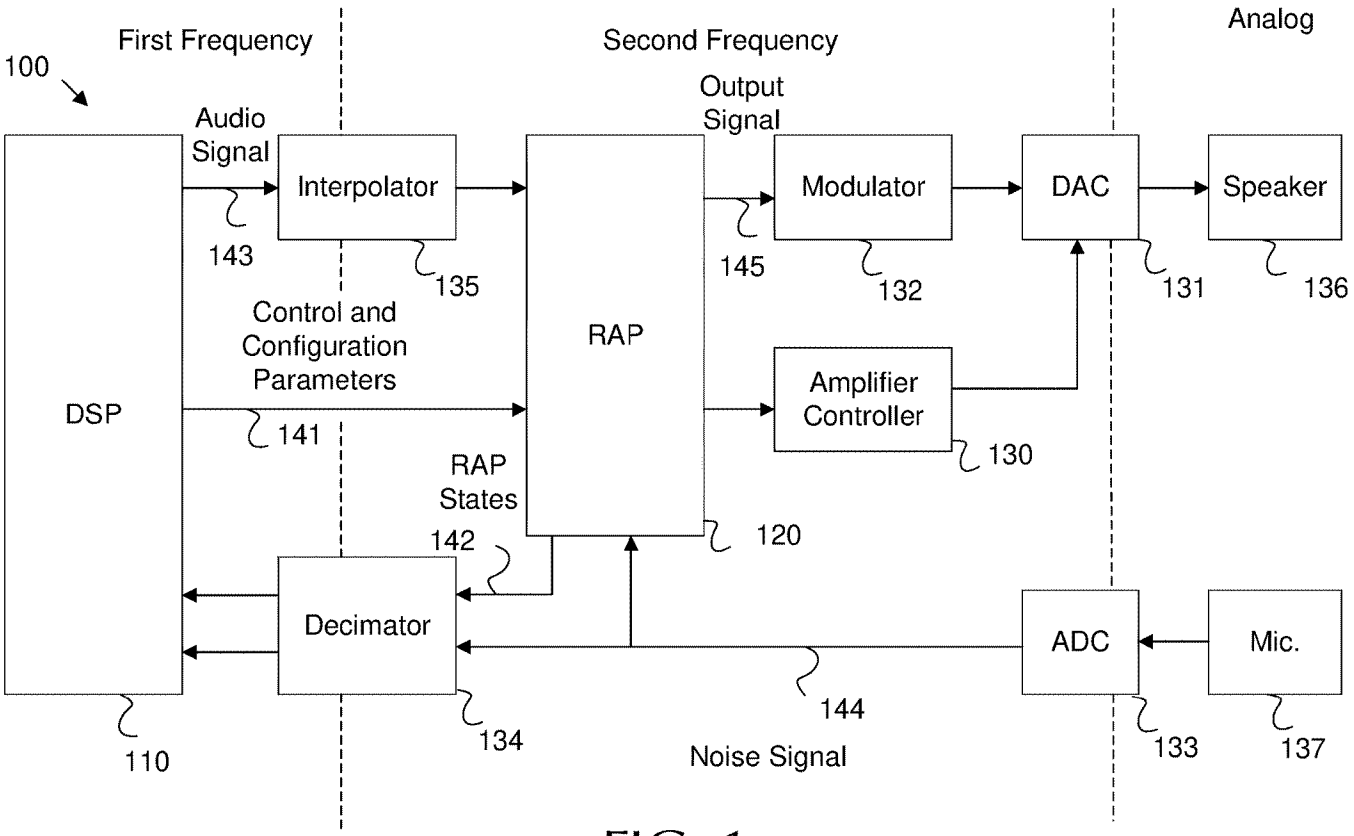
FIG. 1 is a schematic diagram of an example acoustic processing network.

Disclosed herein is an example acoustic processing network. The network includes a Digital Signal Processor (DSP) operating at a first frequency and a RAP operating at a higher second frequency. The DSP is capable of generating robust noise filters to support generation of accurate anti-noise signals. The DSP forwards such noise filters to the RAP for implementation. The RAP operates more quickly than the DSP, and hence can react quickly to auditory changes. This reduces latency and maintains an accurate anti-noise signal. The filters provided by the DSP may depend on user input and/or environmental changes. For example, the DSP may change noise filters when a user moves from a quite environment to a loud environment. As another example, the RAP may employ a compressor circuit that controls adjustable amplifier(s) in a pair of headphones. The compressor circuit may adjust the amplifier(s) based on compressor states, which may limit the speed of volume change in the anti-noise signal. Failure to limit sudden volume changes may result in signal clipping, which may be experienced by the user as pops or clicks of sound. The DSP may adjust compressor states at the RAP based on ambient sound changes to respond to such volume changes. Further, the DSP and RAP may support ambient awareness upon receiving input from a user. Ambient awareness may be associated with a predetermined frequency band, for example a frequency band associated with human speech. The DSP may generate a noise filter that increases the gain for the predetermined frequency band in the noise signal. Accordingly, the RAP amplifies the associated band when generating the anti-noise signal. This may result in cancellation of ambient noise while emphasizing sound (e.g. speech) occurring in a corresponding frequency band. Also, the DSP may provide an audio signal and an audio signal as adjusted based on an expected frequency response of the acoustic processing network. The adjusted audio signal may then be employed by the RAP as a reference point when performing ANC. This allows the RAP to drive the overall output toward the expected audio output instead of driving the output toward zero and canceling some of the audio signal (e.g. canceling low frequency music). Further, the RAP is designed to forward the anti-noise signal to one or more class G controllers, which controls class G amplifier(s) in headphone digital to analog converter (DACs). This supports gain control for the anti-noise signal and further reduces signal artifacts. In addition, the RAP may implement the various noise filters from the DSP by employing biquad filters. Biquad filters may naturally quantize signal samples when storing such samples, which may result in some loss in signal fidelity. In an example, the RAP employs biquad filter(s) implemented to amplify the samples, then quantize the samples, then attenuate the samples. By operating in this order, quantization error is attenuated and hence minimized. This results in a more accurate anti-noise signal.

FIG. 1 is a schematic diagram of an example acoustic processing network 100, which may be used for ANC. The acoustic processing network 100 includes a DSP 110 operating at a first frequency and a RAP 120 operating at a second frequency higher than the first frequency, where the second frequency is higher than the first frequency. For example, the DSP 110 may operate at ninety six kilohertz (khz) or less. In most cases, the DSP 110 may operate at about forty eight khz (e.g. the first frequency). The RAP 120 may operate at a frequency up to about 6.144 Megahertz (MHz). As specific examples, the RAP 120 may operate at 0.768 MHz, 1.5 MHz, 3 MHz, and/or 6.144 (e.g. the second frequency). The DSP 110 may be highly programmable and may contain significant processing power. However, the RAP 120 may operate significantly faster than the DSP 110 due to operating at a higher frequency. Hence, the RAP 120 reacts with much lower latency than the DSP 110. Accordingly, the acoustic processing network 100 employs the DSP 110 to generate audio filters and control the network 100.

Meanwhile, the RAP 120 employs the audio filters provided by the DSP 110 to quickly react to ambient changes when performing ANC and similar functions.

The DSP 110 is any specialized processing circuit optimized from processing digital signals. The DSP 110 support many different functions. For example, acoustic processing network 100 may operate in a set of headphones. When playing music or other audio to a user, the DSP 110 may receive audio input in digital format from memory and/or a general processing unit. The DSP 110 may generate audio signal(s) 143 corresponding to the audio input. The audio signal 143 is/are any stream(s) of digital data including audio to be played to a user via a speaker 136. For example, the DSP 110 may generate a left audio signal 143 for application to a user's left ear and a right audio signal 143 for application to a user's left ear. In some examples, as discussed below, the DSP 110 may generate a pair of audio signals 143 for each ear, etc. The DSP 110 also generates various noise filters for application to the audio signals 143, for example to compensate for noise caused by operation of the acoustic processing network 100.

When providing ANC, the DSP 110 may also generate noise filters to be employed in the generation of an anti-noise signal. In such case, the DSP 110 receives one or more noise signals 144 from one or more microphones 137. The microphones 137 may include a feedforward (FF) microphone positioned outside of the user's ear canal. A FF microphone is positioned to record ambient noise before such noise is experienced by the user. Hence, the DSP 110 may employ the noise signal 144 from FF microphones 137 to determine a prospective noise to be experienced by the user in the near future. The DSP 110 may then generate a noise filter based on the noise signal 144. The noise filter may then be used (e.g. by the RAP 120) to generate an anti-noise signal to cancel out the noise signal 144. The microphones 137 may also include feedback (FB) microphones. A FB microphone is positioned inside a user's ear canal. Hence, a FB microphone 137 is positioned to record noise actually experienced by the user after the anti-noise signal is applied. Accordingly, the noise signal 144 from a FB microphone 137 can be employed to iteratively adjust the noise filter for the anti-noise signal in order to correct for signal errors. It should be noted that the best performance can be achieved by employing at least a FF and a FB microphone 137 for each ear (e.g. four or more microphones 137). However, ANC can be achieved with only FF or only FB microphones 137.

The DSP 110 may communicate with the RAP 110 by providing control and configuration parameters 141. The parameters 141 may include the noise filters for generating anti-noise signals, noise filters for adjusting the audio signal 143, as well as commands to implement various functionality. The RAP 110 may receive the noise filters from the DSP 110 via the control and configuration parameters 141 and then perform various audio processing tasks. The RAP 110 may be any digital processor optimized for low latency digital filtering. When performing ANC, the RAP 120 may also receive the noise signal 144 from the microphones 137. The RAP 120 may generate an anti-noise signal based on the noise signal 144 and the noise filter from the DSP 110. The anti-noise signal may then be forwarded to a speaker 136 for use in ANC. The RAP 120 may also employ the noise filters from the DPS 110 to modify the audio signal 143 for output to the speaker 136. Hence, the RAP 120 may mix an anti-noise signal and the modified audio signal 143 into an output signal 145. The output signal 145 may then be forwarded to the speaker 136 for playback to the user. The speaker 136 may be any headphone speaker(s). In some cases, the microphones 137 may be physically mounted to a pair of speakers 136 (e.g. a left headphone speaker and a right headphone speaker).

As noted above, the RAP 120 may operate at a higher frequency than the DSP 110, and hence may operate at a lower latency than the DSP 110. For example, the DSP 110 may generate noise filters based on general noise level changes in the environment around the user. For example, the DSP 110 may generate different noise filters when the user moves from a noisy room to a quiet room. Such changes occur relatively slowly, and hence the DSP 110 latency is sufficient for such changes. Meanwhile, the RAP 120 applies the noise filters to rapidly adjust to specific noise changes. For example, the RAP 120 may use a noise filter for a noisy room and use such filters to generate an anti-noise signal to reduce particular perceived noises from a falling plate, a crying child, a slamming door, etc. As a specific example, the latency between receiving a noise signal 144 sample from the microphone 137 and forwarding a corresponding anti-noise signal sample to the speaker 136 may be less than about one hundred microseconds (e.g. about five microseconds).

The DSP 110 may also be configured to obtain various RAP states 142 from the RAP 120 for processing purposes. The RAP states 142 may include various states used by a RAP 120 finite state machine as well as other intermediate signals. The DSP 110 may employ RAP states 142 when determining control and configuration parameters 141. As such, the RAP states 142 provide a feedback from the RAP 120 to the DSP 110, which allows for dynamic control of the RAP 120 by the DSP 110. For example, the RAP 120 may employ audio compression, as discussed below, and the RAP states 142 may include compression states. This allows the DSP 110 to dynamically change compression occurring at the RAP 120. It should also be noted that the RAP 120 may employ interrupts to indicate significant events to the DSP 110 such as signal clipping, completion of feathering, instability detected in left channel, instability detected in right channel, etc. Such interrupts may be enable/disabled individually by employing programmable registers.

As shown in FIG. 1, the DSP 110 and the RAP 120 operate in different frequencies in the digital domain while the speakers 136 and the microphones 137 operate in the analog domain. The acoustic processing network 100 employs various components to support conversions between domains and frequency speeds. An interpolator 135 may be employed to increase the frequency of the audio signal 143 from the first frequency used by the DSP 110 to the second frequency used by the RAP 120. An interpolator 135 is any signal processing component that employs interpolation to increase an effective sample rate, and hence frequency of a signal. The audio signal 143 may be sampled at a rate that is auditory to the human ear. The interpolator 135 may increase such sample rate of the audio signal 143 for input into the RAP 120 (e.g. from 48 kHz to 384 kHz). As such, the interpolated audio signal 143 may be considered oversampled for use in audio playback. In other words, the relevant bandwidth for an auditory signal is about 20 kHz. According to the Nyquist criterion, a sampling at 40 kHz is sufficient to completely capture a 20 kHz signal. As such, the audio signal 143 at the RAP 120 can be considered highly oversampled.

Communication between the RAP 120 and the DSP 110 (and along the noise signal path) may proceed via a decimator 134. A decimator 134 is any signal processing component that employs decimation to decrease an effective sample rate, and hence frequency of a signal. Accordingly, the decimator 142 is employed to decrease the frequency of the signals (e.g. RAP states 142 signals and noise signals) from the second frequency used by the RAP 120 to the first frequency used by the DSP 120. In other words, the interpolator 135 upconverts/upsamples signals while the decimator 134 downconverts/downsamples signals.

The network 100 also employs one or more a digital to analog converters (DACs) 131 and one or more analog to digital converter (ADCs) 133 to convert between the analog domain and the digital domain. A DAC 131 is any signal processing component that converts a digital signal to an analog signal. An ADC 33 is any signal processing component that converts an analog signal to a digital signal. Specifically, the ADC 133 receives analog noise signal(s) 144 from the microphones 137 and converts such signals into the digital domain for use by the RAP 120 and the DSP 110. Further, the DAC 131 receives the output signal 145 from the RAP 120 (containing the anti-noise signal and/or the audio signal 143) in digital format and converts the output signal 145 into an analog format that can be output by the speaker(s) 136. In some examples, a modulator 132, such as a delta sigma modulator may also be employed to support the DAC 131. A modulator 132 is a signal component that reduces a bit count and increases a frequency of a digital signal as a pre-processing step prior to digital to analog conversion by a DAC 131. A modulator 132 may support the DAC 131 and hence may not be employed in some examples. It should be noted that the modulator 132 and the DAC 131 may have fixed transfer functions. As such, the RAP 120 may be the final block in the audio processing chain with significant configurability.

The DAC 131 may employ an amplifier, such as a class G amplifier, to increase a volume of the output signal 143 to an appropriate level for playback by the speaker 136. The network 100 may employ an amplifier controller 130, such as a class G amplifier controller, to control the DAC 131 amplifier. For example, low volume output signals 145 may require little amplification (e.g. anti-noise signal for a quiet environment and/or a silence in the audio signal 143). Conversely, a high volume output signal 145 may require significant amplification (e.g. a significant anti-noise signal due to a loud noise and/or loud music in audio signal 143). As the DAC 131 may output an anti-noise signal that is potentially highly variable, sudden changes in volume may occur. Such sudden changes may cause audio artifacts. For example, a sudden change from silence to a loud anti-noise signal (e.g. sudden applause in a quiet room) may result in signal clipping by the DAC 131 amplifier when the output signal 145 suddenly increases beyond the capability of the amplifier in the DAC 131. Such clipping is experienced by a user as popping or clicking. To avoid such artifacts, the RAP 120 may forward a copy of the anti-noise signal to a digital to the amplifier controller 130 to support adjusting the DAC 131 amplifier (e.g. by modifying applied voltage) based on the anti-noise signal level. The amplifier controller 130 may dynamically review changes in the anti-noise signal to project potential changes in the output signal 145. The amplifier controller 130 can then modify DAC 131 amplifier setting to lower amplification and save power or increase amplification to prevent clipping based on changes in the anti-noise signal (and/or changes in the audio signal 143). The above function as generally discussed with respect to FIG. 1 are discussed in greater detail below. It should be noted that each of these functions can be activated alone or in combination based on user input (e.g. ANC can be active with our without audio input, etc.).

It should also be noted that the noise going into a user's ear depends on many factors including the shape of the head and ear, as well as the seal and the fit of the headphones. The acoustic signal produced by a headphone may also depend on the seal between the user's ear and the headphone. In other words a transfer function of the headphone may depend on the seal. Because of these variabilities a single ANC filter design for generating an anti-noise signal may not be optimal for all users. Adaptive ANC leads to an ANC filter design that is optimized for the current user. The adaptive ANC is made possible because the DSP 110 has access to the FF and FB microphone 137 noise signals 144. The DSP 110 can estimate the transfer function between the FF and FB noise signals 144 for a particular user during a calibration phase. For example, the DSP 110 may determine what noise should be inside the ear given the noise at FF microphone 137. A second part of a calibration process may estimates the transfer function of the headphone by playing a specially designed signal into the headphone and recording the FB microphone 137 signal. Once the DSP 110 has computed an optimized FF ANC filter, the DSP 110 can program the coefficients in RAP 120.

Figure 2:
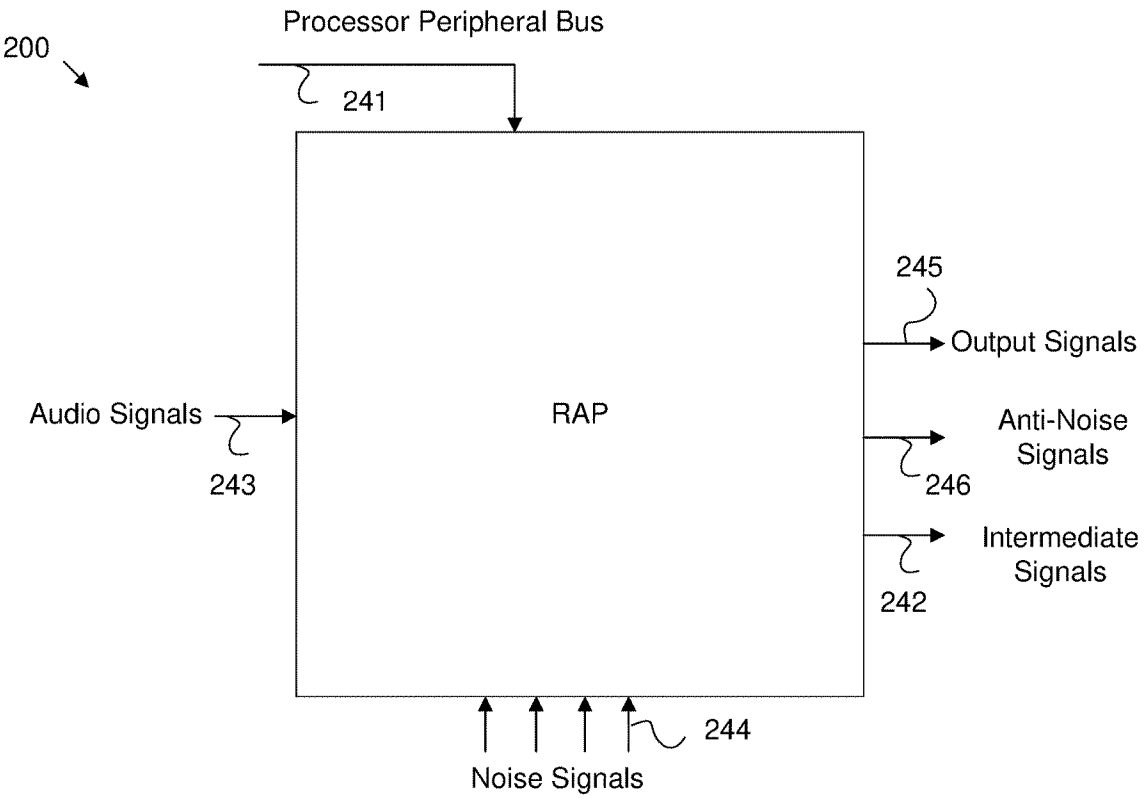
FIG. 2 is a schematic diagram of an example Real-Time Acoustic Processor (RAP) input/output (I/O).

FIG. 2 is a schematic diagram of an example RAP I/O 200, which may be applicable to a RAP such as RAP 120. The RAP I/O 200 includes a processor peripheral bus 241, which may be a communication link for receiving control and configuration parameters from a DSP (e.g. control and configuration parameters 141), such as user inputs, commands, computed noise filters, compression filters, ambient awareness filters, and/or any other filters discussed herein. The RAP I/O 200 also includes an input for audio signals 243 from a DSP (e.g. music), which may be substantially similar to audio signals 143. The RAP I/O 200 further includes an input for noise signals 244, which may be substantially similar to noise signals 144. The noise signals 244 are depicted as four inputs to depict the example where a FF and a FB microphone are employed on a left and right headphone, respectively, resulting in four noise signals 244. However, any number of noise signals 244 may be employed. The RAP I/O 200 includes outputs for output signals 245, anti-noise signals 246, and intermediate signals 242. The anti-noise signals 246 may be generated based on noise filters received via the processor peripheral bus 241 and noise signals 244 received from corresponding microphones. The anti-noise signals 246 may be forwarded to an amplifier controller to support control of a DAC amplifier to mitigate clipping and related noise artifacts. The output signals 245, which may be substantially similar to output signal 145, may contain the anti-noise signals 246 mixed with equalized audio based on audio signals 243. The output signals 245 may be forwarded to left and right speakers for playback to the user. Intermediate signals 242 may include partially equalized audio signals, anti-noise signals 246, partially generated anti-noise signals, RAP states, compression states, current filters in use, and/or any other RAP information indicating the audio processing performed by the RAP. The intermediate signals 242 may be forwarded to the DSP as feedback to allow the DSP to consider current RAP operating parameters when making changes to RAP functionality. Accordingly, the intermediate signals 242 may allow the DSP to modify RAP configurations dynamically for increased performance and sophisticated control. Some of the intermediate signals 242 may pass through a decimation filter for resampling in order to match the intermediate signals 242 to the processing frequency employed by the DSP. Other intermediate signals 242 (e.g. slowly changing signals such as signal level and processor gain) are made available to the DSP for periodic sampling via register interfaces. It should be noted that RAP I/O 200 may contain other inputs and/or outputs. RAP I/O 200 describes the major functional I/O, but is not intended to be exhaustive.

Figure 3:
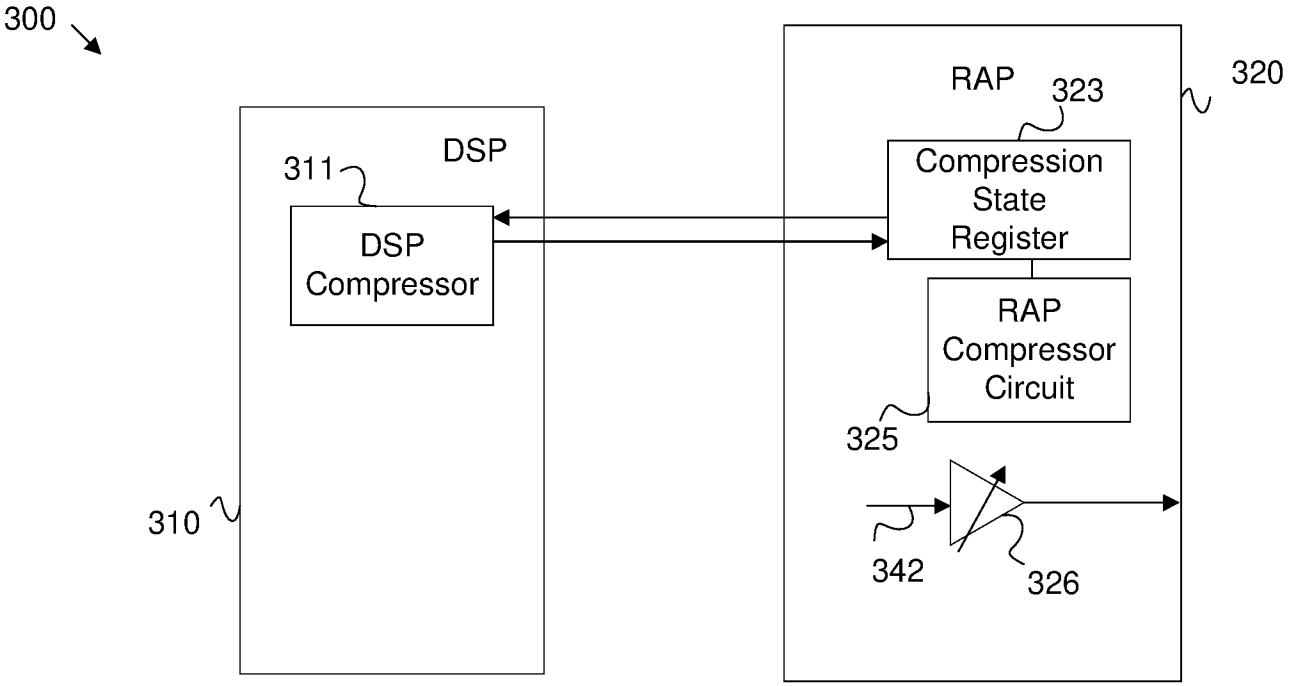
FIG. 3 is a schematic diagram of an example acoustic processing network for compressor state sharing.

FIG. 3 is a schematic diagram of an example acoustic processing network 300 for compressor state sharing. Network 300 includes a DSP 310 and a RAP 320, which may be substantially similar to DSP 110 and RAP 120, respectively. Other components are omitted for clarity. The RAP 320 includes an adjustable amplifier 326, which may be any circuit capable of modifying the gain of a signal to a target value set by the RAP 320. As noted above, the RAP 320 generates anti-noise signals 342 based on filters from the DSP 310 and noise signals from microphones. The adjustable amplifier 326 amplifies the anti-noise signal 342 to a sufficient value to cancel out noise (e.g. after conversion by the DAC and associated amplifiers). The RAP 320 also includes a RAP compressor circuit 325, which may be any circuit configured to control an adjustable amplifier 326. Specifically, the RAP compressor circuit 325 controls the adjustable amplifier 326 to mitigate artifacts in the anti-noise signal 342 due to clipping and the like. The RAP 320 also includes a compression state register 323, which may be any read/wrote memory component. The compression state register 323 stores compression states, and the RAP compressor circuit 325 controls the adjustable amplifier 326 based on the compression states.

The RAP compressor circuit 325 and adjustable amplifier 326 may be employed to mitigate sudden drastic changes in anti-noise signal 342 value. For example, the RAP compressor circuit 325 and adjustable amplifier 326 may mitigate a sudden rise in anti-noise signal 342 value (and associated signal artifacts) due to a car door slam, but may allow the anti-noise signal 342 to rise for a continuous increase in sound due to movement from a quiet room to a loud room. In order to determine how to adjust the adjustable amplifier 326, the RAP compressor circuit 325 considers the compression states stored in the compression state register 323. The compression states may include a peak signal estimate, an instantaneous gain, a target gain, an attack parameter, a release parameter, a peak decay parameter, a hold parameter, and/or a Root Mean Square (RMS) parameter for the anti-noise signal 342. The peak signal estimate includes an estimate of the maximum expected value of the anti-noise signal 342. The peak signal estimate can be employed to determine an appropriate amount of amplification to prevent any portion of the anti-noise signal 342 from being amplified beyond the range of a DAC amplifier (e.g. resulting in clipping). The instantaneous gain indicates the current gain provided by the adjustable amplifier 326 at a specified instant, and the target gain indicates an adjusted gain that the adjustable amplifier 326 should move to in order to adjust for a signal change. The attack parameter indicates the speed at which an increased gain adjustment should be made without causing signal artifacts. A release parameter indicates the speed at which a decreased gain adjustment should be made without causing signal artifacts. The hold parameter indicates how long an increased gain should be provided after the anti-noise signal 342 has returned to a normal value, for example to provide for the possibility the another loud noise will occur. The peak decay parameter indicates the amount the anti-noise signal 342 must vary from a peak value before the anti-noise signal 342 can be considered to have returned to a normal value for purposes of the hold parameter. In addition or in the alternative, the adjustable amplifier 326 may be adjusted based on the RMS of the anti-noise signal 342 to mitigate clipping.

The RAP 320 operates much more quickly than the DSP 310, but may be limited to much less sophisticated compression algorithms. Accordingly, the DSP 310 includes a DSP compressor 311. The DSP compressor 311 is a programmable circuit capable of considering the compression states of the RAP 320 and applying complex compression algorithms to the compression states to determine more accurate adjustable amplifier 326 settings on a slower time scale. As such, the DSP 310 is configured to receive current compression states from the RAP 320 as stored in the compression state register 323. Such data may be communicated via an intermediate signal output (e.g. intermediate signal 242) and/or a RAP states signal path (e.g. RAP states 142). The DSP compressor 311 may determine new compression states based on the noise signal and the current compression states. The DSP compressor 311 may then forward the new compression states to the RAP to support controlling the adjustable amplifier 326. For example, the DSP compressor 311 may forward the new compression states to the compression state register 323, and hence directly program the RAP 320 for compression.

Figure 4:
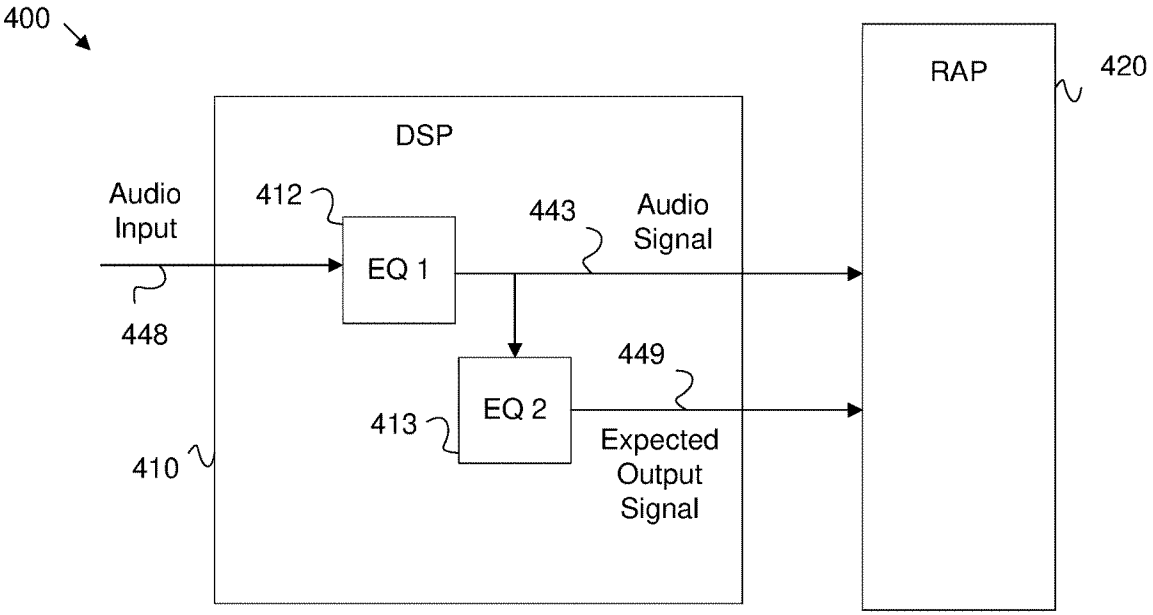
FIG. 4 is a schematic diagram of an example acoustic processing network for audio input equalization.

FIG. 4 is a schematic diagram of an example acoustic processing network 400 for audio input equalization. The acoustic processing network 400 includes a DSP 410 and a RAP 420, which may be substantially similar to DSP 110 and 310 and RAP 120 and 320, respectively. As discussed above, the DSP 410 may generate an audio signal 443 for use by the RAP 420 based on audio an input 448. The DSP 410 may employ a first equalizer 412 to generate the audio signal 443. An equalizer is any circuit that adjusts a frequency response of a network for practical or aesthetic reasons. For example, the first equalizer 412 may adjust audio bass, treble, etc. to customize the audio signal 443 for the frequency response of the network 400.

A difficulty arises when applying an anti-noise signal to cancel noise at the same time audio is being played to a user. Specifically, FB microphones in the user's ear canal may record all or part of the audio signal 443 as noise. In such a case, the RAP 420 may generate an anti-noise signal that cancels part of the audio signal 443. For example, the anti-noise signal may cancel out some lower frequency audio from the audio signal 443, which may result in erroneous performance by the headphones. To combat this problem, the DSP 410 includes a second equalizer 413. The second equalizer 413 is substantially similar to the first equalizer 412, but is employed for a different purpose. The DSP 410 and/or the second equalizer 413 model the frequency response of the network 400. The second equalizer 413 then employs the models to generate an expected output signal 449 based on the audio input 448 and a frequency response of the acoustic processing network 400. The expected output signal 449 is effectively a copy of audio signal 443 as modified by the expected effect of the circuitry in network 400. When no audio is provided, an ANC process may attempt to drive the noise to zero. By forwarding the expected output signal 449 to the RAP 420, the ANC process can set the expected output signal 449 as a reference point. As such, the ANC process can drive the output signal from the RAP 420 down to the expected output signal 449 instead of zero. This approach may reduce/remove any ANC effects on the audio signal 443.

Accordingly, the RAP 420 receives the audio signal 443 from the DSP 410. The RAP 420 then mixes the audio signal 443 with an anti-noise signal. The RAP 420 also sets the expected output signal 449 as a reference point when generating the anti-noise signal to mitigate cancellation of the audio signal by the anti-noise signal.

Figure 5:
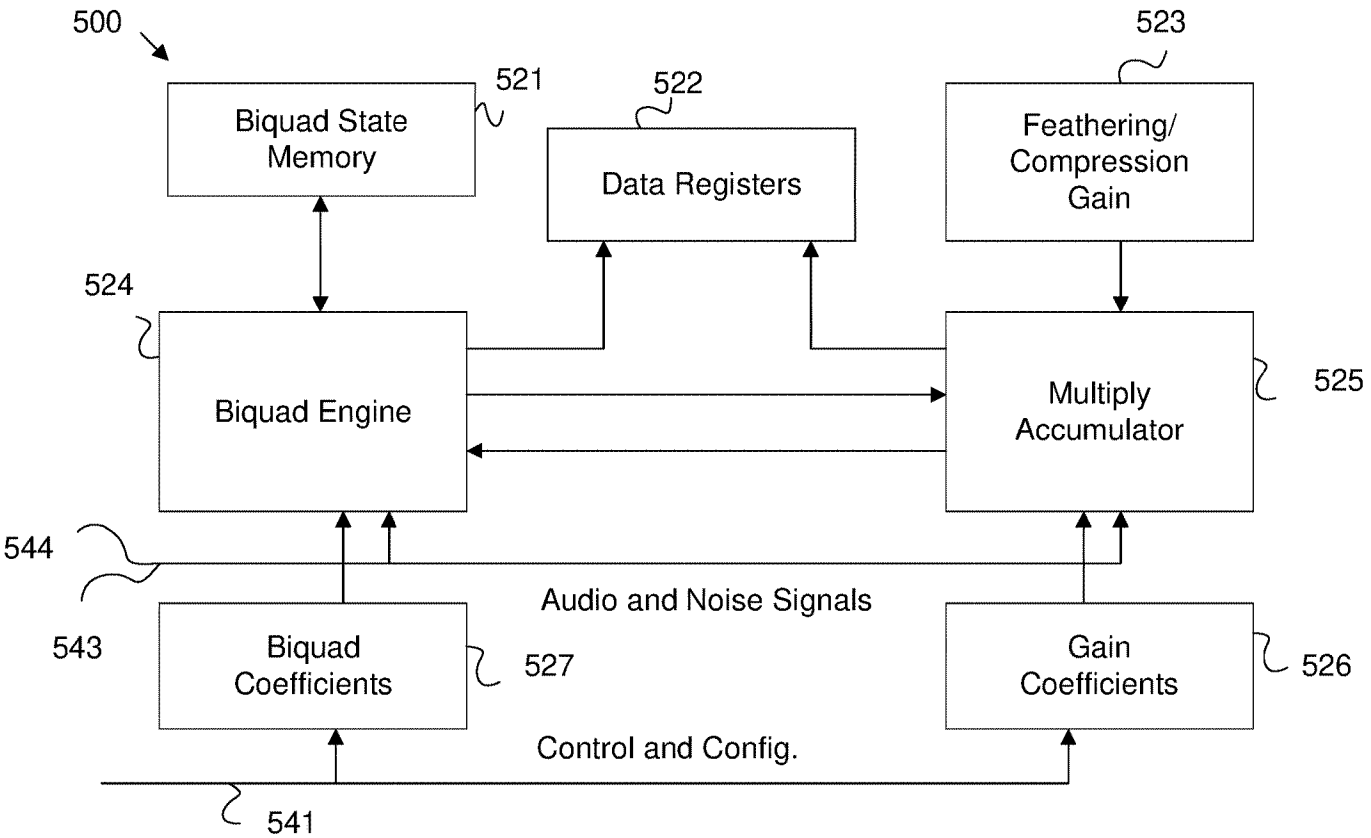
FIG. 5 is a schematic diagram of an example RAP architecture.

FIG. 5 is a schematic diagram of an example RAP architecture 500. For example, RAP architecture 500 may be employed in RAP 120, 320, and/or 420. The RAP architecture 500 employs a biquad engine 524, a multiply accumulator 525, data registers 522, and a biquad memory 521. These components employ biquad coefficients 527, gain coefficients 526, and feathering/compression gain coefficients 523 to filter input in order to generate output signals, such as output signal 145.

A biquad engine 524 is a circuit that generates digital filters with two poles and two zeros. A pole is a root of the denominator of a polynomial of a transfer function of the system and a zero is a numerator of the polynomial of the transfer function. In other words, the poles push the signal being filtered toward infinity and the zeros push the signal being filtered toward zero. It should be noted that such a filter has an infinite impulse response (IIR) when the poles are non-zero. Such filters may be denoted as biquadratic or biquads, which refers to the concept that the transfer function of the filter is a ratio of two quadratic functions. The biquad engine 524 operates on a higher frequency than the signals processed by the biquad engine 524. As such, the biquad engine 524 can be applied multiple times to a single sample of a signal and/or applied in different ways to different portions of the signal. The biquad engine 524 is programmable, and hence can be employed to create various topologies for processing as discussed below. Although the RAP architecture 500 is described as using biquad filters, other filter architectures, i.e. having other than two zeros and two poles, may be substituted for the biquad filters depending on the particular implementation details.

The multiply accumulator 525 is a circuit that adds and/or multiplies values. For example, the multiply accumulator 525 may be employed to scale signals and/or signal portions. The multiply accumulator 525 may also be employed to compute weighted sums of multiple signals and/or signal portions. The multiply accumulator 525 may accepts output from the biquad engine 524 and vice versa. The data registers 522 may be any memory components for storing data. Specifically, the data registers 522 may store signals, such as output of the biquad engine 524 and/or the multiply accumulator 525. As such, the biquad engine 524, multiply accumulator 525, and the data registers 522 can operate together to iteratively apply mathematical and/or other specialized digital signal alteration processes on a sample of an audio signal 543 and/or a noise signal 544. The audio signal 543 and noise signal 544 may be substantially similar to audio signal 143 and noise signal 144, respectively.

The biquad state memory 521 is a memory module, such as a register, for storing a current biquad state. The biquad engine 524 is programmable to operate as a finite state machine. The biquad state memory 521 stores data indicating the available states and/or the current state of the biquad engine 524. The biquad engine 524 may read data from and store fata to the biquad state memory 521.

In summary, the biquad engine 524 and multiply accumulator 525 may be programmed to implement various topologies by employing state data from the biquad state memory 521. Further, intermediate signal data can be stored in the data registers 522. The RAP architecture 500 receives control and configuration parameters 541, which may be substantially similar to control and configuration parameters 141. The control and configuration parameters 141 include noise filters encoded in terms of biquad coefficients 527 and gain coefficients 526. The biquad engine 524 alters the shape of the signal being operating upon (e.g. audio signals and/or noise signals 543/544) based on the biquad coefficients 527, which may be stored in local memory upon receipt from a DSP. Further, multiply accumulator 525 increases/alters the gain of the signal being operating upon (e.g. audio signals and/or noise signals 543/544) based on the gain coefficients 526, which may be stored in local memory upon receipt from a DSP.

In some cases, gain coefficients may be feathered. Feathering indicates a gradual change from a first value to a second value. The multiply accumulator 525 may act as a feathering unit by implanting feathering coefficients received from a feathering/compression gain 523 input. For example, the multiply accumulator 525 may implement three feathering units for a left channel and three feathering units for a right channel. In another example, the multiply accumulator 525 may implement six feathering units for each channel.

The multiply accumulator 525 may also receive compression states from the feathering/compression gain 523 input. The compression states may be substantially similar to compression states 323, may be stored in local memory, and may be received from a DSP. The multiply accumulator 525 may act as a compressor (e.g. a non-linear processor) that can change the gain applied on a signal if the signal becomes too strong. This may be used to dynamically turn the gain down in the signal flow to avoid clipping. For example, a compressor applied on an anti-noise signal may temporarily reduce the gain when the anti-noise becomes too strong for the DAC. This reduces the ANC strength temporarily, but prevents unpleasant artifacts that arise from signal clipping. The multiply accumulator 525 may implement three compressor units for a left channel and three compressor units for a right channel. In another example, the multiply accumulator 525 may implement six compressor units for each channel.

By employing the various coefficients across a plurality of states in a finite state machine, the RAP architecture 500 may implement one or more programmable biquad filters. These biquad filters may in turn to implement the noise filter from the DSP and generate the anti-noise signal. The RAP architecture 500 may also mix anti-noise/noise signals 544 with audio signals 543. Further, the RAP architecture 500 may apply filters to the audio signals 543 as desired.

Figure 6:
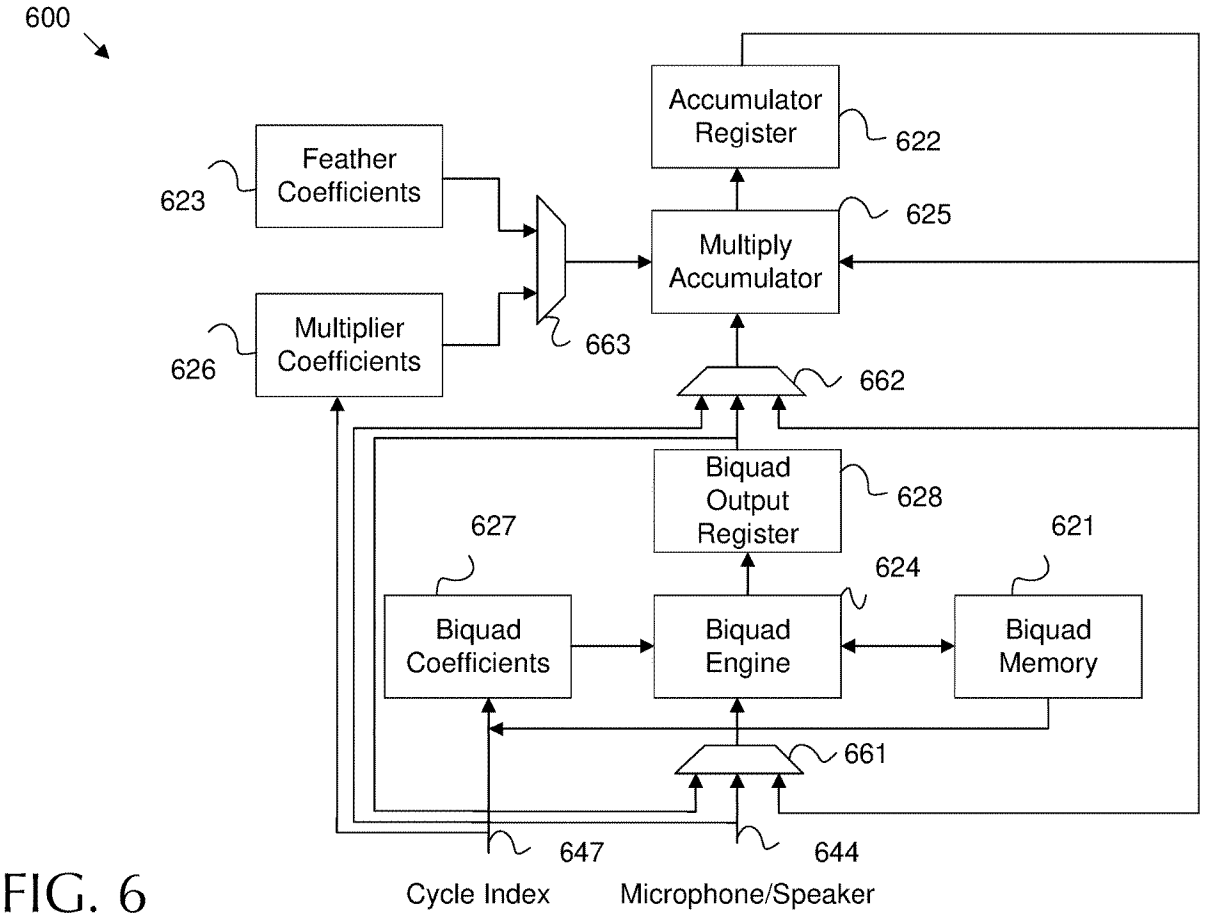
FIG. 6 is a schematic diagram of another example RAP architecture.

FIG. 6 is a schematic diagram of another example RAP architecture 600. RAP architecture 600 is an implementation specific version of RAP architecture 500. RAP architecture 600 is depicted as operating to generate ANC with audio signal processing omitted for purposes of clarity. The RAP architecture 600 includes a multiply accumulator 625, which is a circuit for multiplying and/or adding signal data. The RAP architecture 600 also includes an accumulator register 622, which is a memory circuit for storing an output of the multiply accumulator 625. Together, the multiply accumulator 625 and the accumulator register 622 may implement a multiply accumulator 525. The RAP architecture 600 also includes a biquad engine 624 and a biquad output register 628, which together may implement a biquad engine 524. The biquad engine 624 is a circuit for implementing filters, and the biquad output register 628 is a memory for storing results of computations by the biquad engine 624. The RAP architecture 600 also includes a biquad memory 621, which may be a memory unit for storing partial results from the biquad engine 624. The biquad memory 621 may also implement a biquad state memory 521.

The components are coupled together and to external local memory and/or remote signals (e.g. from the DSP) by multiplexer (MUX) 661, MUX 662, and MUX 663 as shown. The components may receive feathering coefficients 623, multiply coefficients 626, and biquad coefficients 627 as shown, which may be substantially similar to feathering/compression gain 523, gain coefficients 526, and biquad coefficients 527, respectively. The components may receive a noise signal 644 from the microphones/speakers for ANC. The noise signal 644 may be substantially similar to noise signal 144. The components may also receive a cycle index 647. The cycle index 647 is data that indicates a current position in the RAPs duty cycle. The various signals, indexes, and coefficients are routed to their respective components via the MUXs 661-663 as shown.

In operation, the cycle index 647 is employed to select the biquad coefficients 627 for a corresponding state. The biquad coefficients 627 and/or cycle index 647 are forwarded to the biquad engine 624 for application to the noise signal 644. State information may be obtained from biquad memory 621. Also, partial results may be stored in the biquad memory 621 and/or fed back into the biquad coefficients 627 for application in a next state. The completed results may be stored in the biquad output register 662 for output toward the multiply accumulator 625. In addition, the output from the biquad output register 662 can be fed back into the biquad engine 624. Also, the output from the accumulator register 622 can be forwarded back into the biquad engine 624. Further, the noise signal 644 can bypass the biquad engine 624 and move directly to the multiply accumulator 625.

The cycle index 647 is also employed to select the multiply coefficients 626 for a corresponding state. The multiply coefficients 626, feather coefficients 623, and/or cycle index 626 are also forwarded to the multiply accumulator 625 for application to the various inputs. The multiply accumulator 625 may receive as inputs the output of the biquad output register 662, the noise signal 644, and/or the output of the multiply accumulator 625. In other words, the output of the multiply accumulator 625 may be fed back into the input of the multiply accumulator. Once the coefficients are applied to the input(s) based on the corresponding state, the output of the multiply accumulator 625 is stored in the accumulator register 622 for output to other components. The output of the accumulator register 622 and/or the output of the biquad output register 628 may also be forwarded toward a speaker as the output of the RAP architecture 600. The interconnectivity of RAP architecture 600 allows the components to be programmed to implement the various topologies to apply various audio processing schemes as discussed below.

Figure 7:
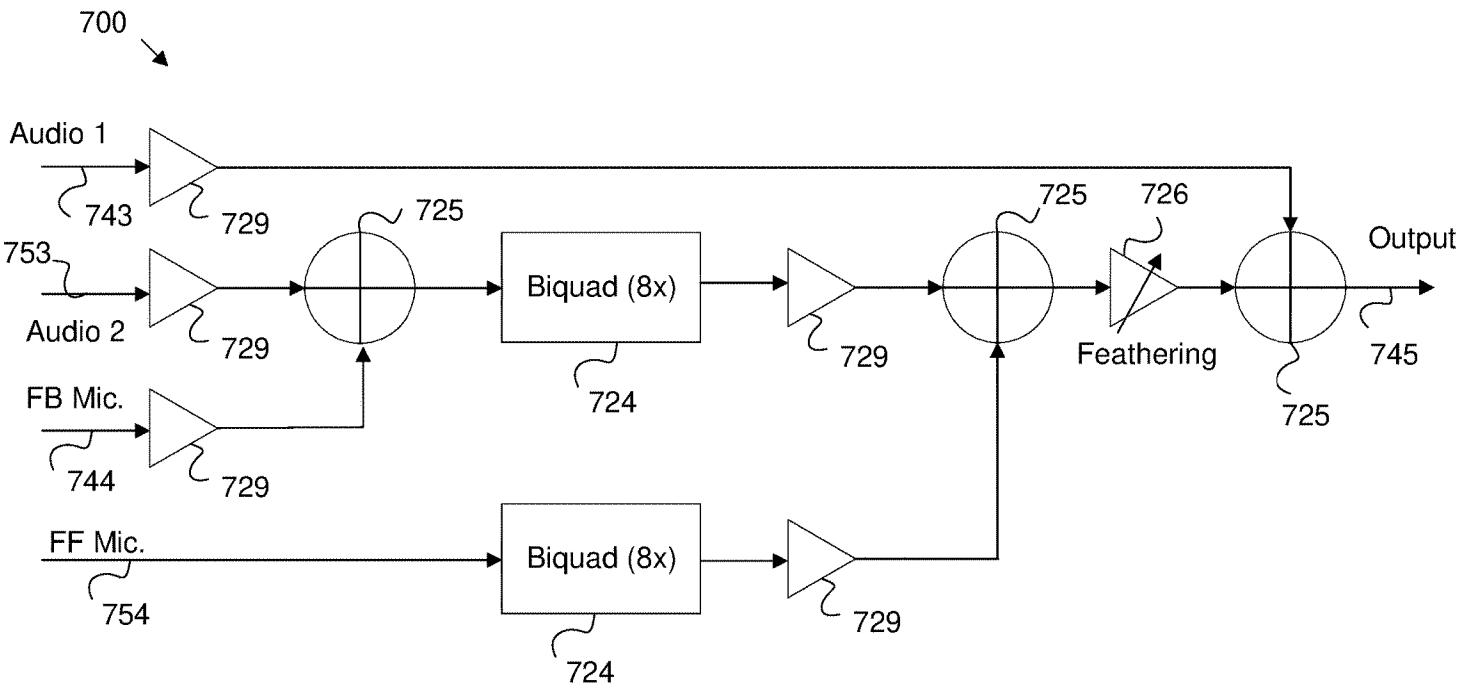
FIG. 7 is a schematic diagram of an example programmable topology in a RAP.

FIG. 7 is a schematic diagram of an example programmable topology 700 in a RAP such as RAP 120, 320, and/or 420, as implemented according to RAP architecture 500 and/or 600. The topology 700 is configured to provide ANC while outputting an audio signal. The topology 700 receives a first audio signal (Audio 1) 743 and a second audio signal (Audio 2) 753. The audio signals 743 and 753 may be substantially similar to audio signal 143, and may include separate audio for the left and right ear, respectively. In some examples, the audio signals 743 and 753 may be an expected output signal 449 and an audio signal 443, respectively. The topology 700 also receives FB microphone signal(s) 744 and FF microphone signal(s) 754, which may be substantially similar to noise signals 144. The audio signals 743 and 753 and the noise signals including the FB microphone signal 744 and the FF microphone signal 754 are employed to generate an audio signal with ANC as an output 754.

The topology employs amplifiers 729 to amplify the first audio signal 743, the second audio signal 753, and the FB microphone signal 744. Such amplifiers may be implemented by a multiply accumulator, such as multiply accumulator 525 during a first three states by employing gain coefficients. The second audio signal 753 and the FB microphone signal 744 are then mixed by a mixer 725. The mixer 725 may be implanted by a multiply accumulator in a fourth state. The output of the mixer is then forwarded through a series of biquad filters 724, in this example a cascade of eight consecutive biquad filters 724. The biquad filters 724 may be implemented by a multiply accumulator and a biquad engine 524 by employing corresponding sets of biquad coefficients 527 (e.g. over the course of eight states). Meanwhile the FF microphone signal 754 is also sent through a series of biquad filters 724, in this example eight biquad filters 724. The FF microphone signal 754 and the combined second audio signal 753 and FB microphone signal 744 are each amplified by amplifier 729 and combined by a mixer 725 (e.g. each implemented in corresponding states of a multiply accumulator). The combined FF microphone signal 754, second audio signal 753, and FB microphone signal 744 are then forwarded via a feathering amplifier 726 for feathering. This may be implemented by a multiply accumulator employing feather coefficients, for example from a feathering/compression gain 523. The results are then mixed by a mixer 725 (e.g. which may be implemented by a multiply accumulator), resulting in the output 745.

As can be seen by the above discussion, the components of a biquad engine and a multiply accumulator may apply various computations to a sample from each signal at various states. The a biquad engine and a multiply accumulator traverse the various states to implement the topology 700 and hence perform the corresponding computations on the samples, which results in the output 745. Once an output 745 is generated for a set of samples, another set of samples is taken and altered via the various states to result in another output 745, etc. Further, the topology 700 can be changed by reprogramming the biquad engine and multiply accumulator states as associated coefficients.

Figure 8:
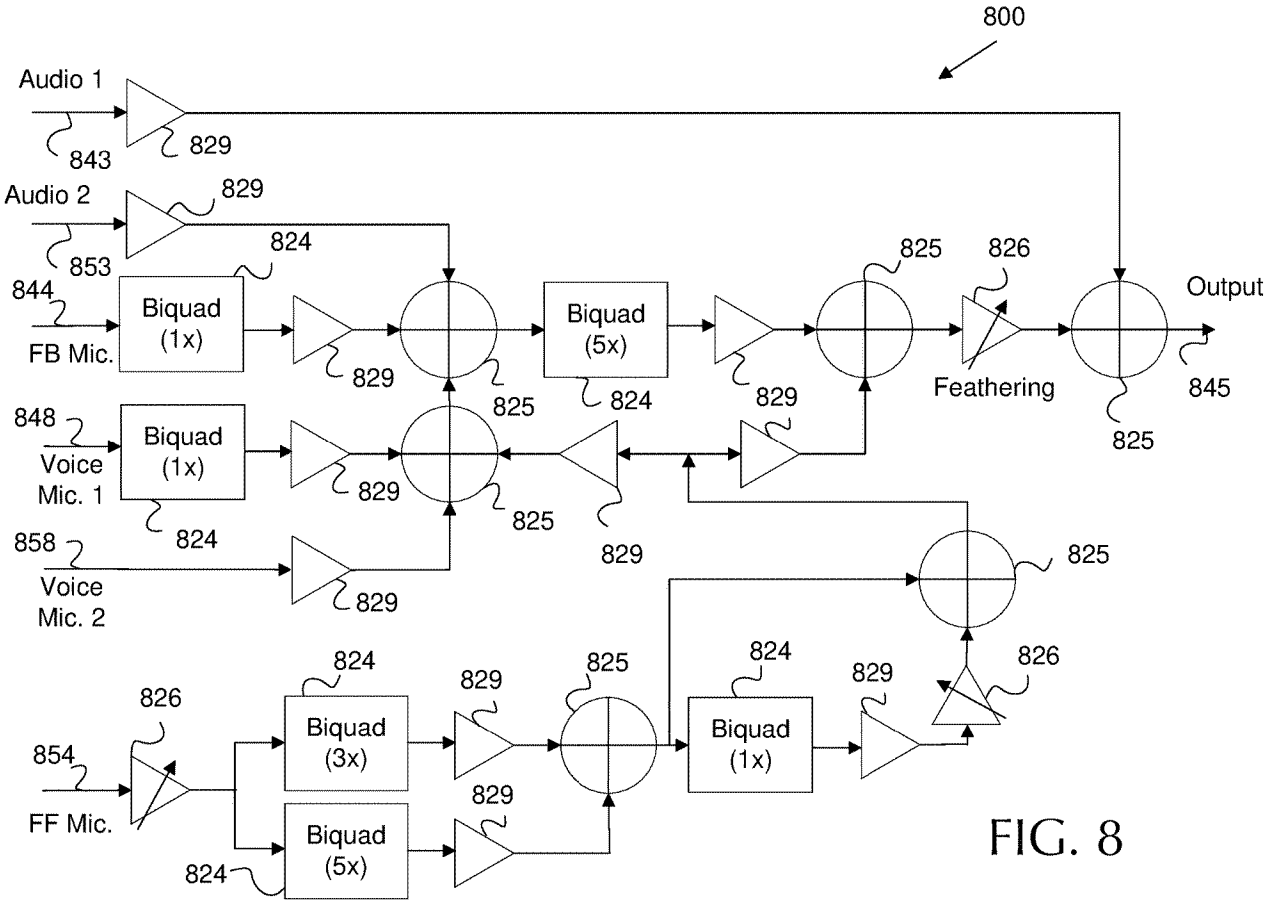
FIG. 8 is a schematic diagram of another example programmable topology in a RAP.

FIG. 8 is a schematic diagram of another example programmable topology 800 in a RAP such as RAP 120, 320, and/or 420, as implemented according to RAP architecture 500 and/or 600. For example, topology 800 may be created by reprogramming topology 700. Topology 800 is configured to provide adaptive ANC, ambient awareness, and side tone emphasis. As such, topology 700 may be reconfigured to obtain topology 800 upon receiving input from a user to include ambient awareness and side tone. Ambient awareness operates to emphasize a particular predetermined frequency band. For example, a frequency band associated with human speech may be emphasized so that ANC cancels out noise while emphasizing speech as part of a conversation. Side tone refers to a user's voice. Hence, the topology 800 may be employed to provide side tone emphasis, which allows user to hear the user's own voice clearly. As such, topology 800 may reduce ambient noise while allowing a user to clearly hear another person's voice as well as the user's own voice. Accordingly, topology 800 may be employed to convert a pair of headphones into a hearing enhancement device.

Topology 800 employs biquad filters 824 which may be implemented by a biquad engine, such as a biquad engine 524 in a manner similar to topology 700. Topology 800 also employs amplifiers 829, mixers 825, and feathering amplifiers 826, which may be implemented by a multiply accumulator, such as a multiply accumulator 525 in a manner similar to topology 700. The topology 800 receives a first audio signal (Audio 1) 843, a second audio signal (Audio 2)

853, a FB microphone signal 844, and a FF microphone signal 854, which are substantially similar to the first audio signal 743, the second audio signal 753, the FB microphone signal 744, and the FF microphone signal 754, respectively.

The FF microphone signal 854 is employed for ambient awareness. For example, the biquad filters 824 in the FF microphone signal 854 path act as an ambient awareness filter. Accordingly, the FF microphone signal 854 path may apply an ambient awareness filter to enhance a predetermined frequency band in the noise signal when the topology 800 is generating an anti-noise signal. This may result in an enhanced predetermined frequency band, such as a speech band. The FF microphone signal 854 path may forward the anti-noise signal with the enhanced predetermined frequency band to a speaker via output 845 for output to a user.

Further, topology 800 employs a first voice microphone signal (voice mic. 1) 848 and a second voice microphone signal (voice mic. 2) 858. Such signals may be recorded by microphone(s), such as microphone 137, positioned to record a user's voice. For example, such microphone(s) may be included on a lapel clip attached to headphones and positioned on a user's chest. Hence, the first voice microphone signal 848 and the second voice microphone signal 858 may include samples of the side tone (e.g. the user's voice).

Functionally, the FB microphone signal 844 and the first voice microphone 848 are each forwarded through a biquad filter 824 and an amplifier 829. Further, the second voice microphone signal 858 and the second audio signal 853 forwarded through amplifiers 829. Such lines are then combined via mixers 825 as shown. The results are forwarded through a set of biquad filters 824, in this case five consecutive filters, and another amplifier 829. Such signals include the side tone, the FB portion of the ANC, the second portion of the audio signal.

Meanwhile, the FF microphone signal 854, which includes the FF portion of the ANC as well as the ambient awareness portion, is forwarded via a feathering amplifier 826. This feathering amplifier 826 may be employed to softly change ambient awareness and ANC modes. The FF microphone signal 854 is then sent in parallel via biquad filters 824, in this case three consecutive filters and five consecutive filters. The results are then amplified via amplifiers 829 and mixed by a mixer 825. A portion of the mixed results are forwarded through a biquad filter 824, an amplifier 829, and a second feathering amplifier 826. Another portion of the mixed results are forwarded in parallel around such components. The path is then mixed back together by a mixer 825. The second feathering amplifier 826 employs a compressor to enable strong FF ANC without signal clipping.

The results of the FF microphone signal 854 path are then amplified by amplifiers 829 before being mixed into the signal path containing the side tone, the FB portion of the ANC, the second portion of the audio signal. As shown, the FF microphone signal 854 path is mixed in before and after the five biquad filters 824 via mixers 825. The results of such signals are passed through another feathering amplifier 826, which is employed to softly turn ANC on and off. Such feathering amplifier 826 may also apply a digital compressor to further mitigate clipping. Further, the first audio signal is amplified via an amplifier 829 and mixed with the rest of the signals via a mixer 825. This may result in an output 845 containing audio signal(s), an FF anti-noise signal, an FB anti-noise signal, a side tone, and ambient awareness emphasis all mixed together for playback to a user via speaker(s).

Figure 9:
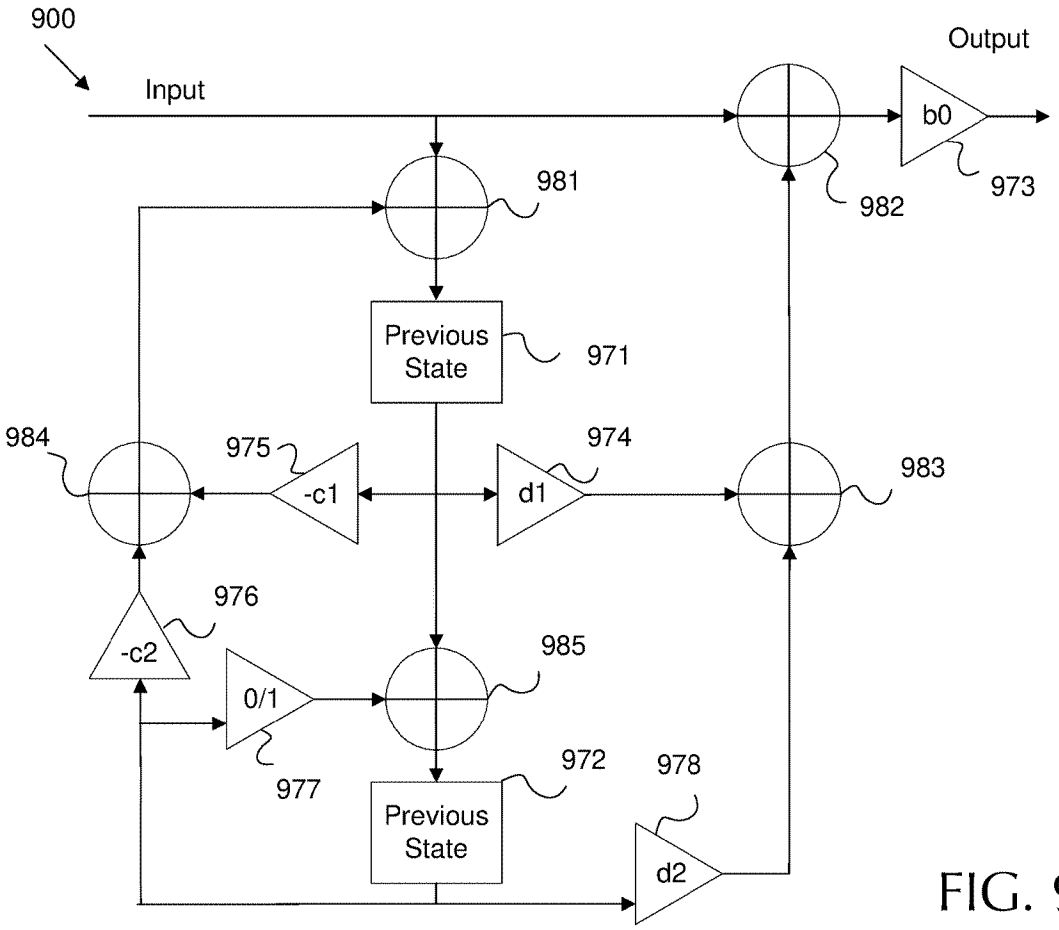
FIG. 9 is a schematic diagram of a biquad filter structure.

FIG. 9 is a schematic diagram of a biquad filter 900 structure which may be employed by a biquad engine, such as biquad engine 524 and/or 624, for application to noise signals, anti-noise signals, audio signals, and/or any other signals disclosed herein. A biquad filter is generally described mathematically according to equation 1 below:

$$y[n]=b_0x[n]+b_1x[n-1]+b_2x[n-2]-a_1y[n-1]-a_2y[n-2] \qquad \text{Equation 1}$$

where x[n] is an input to the biquad filter, y[n] is an output from the biquad filter, and $b_0$, $b_1$, $b_2$, $a_1$, and $a_2$ are biquad coefficients, such as biquad coefficients 527 and/or 627. The function of the biquad filter 900 can therefore be modified by modifying the coefficients.

Biquad filter 900 instead employs different coefficients. Specifically, biquad filter 900 employs gain coefficients $b_0$ 973, $-c_1$ 975, $-c_2$ 976, $d_1$ 974, and $d_2$ 978 as shown. Such gain coefficients 973 may be implemented by adjustable amplifiers. Further, such coefficients are defined mathematically in reference to equation 1 by equations 2-5 below:

$$c_1 = 1 + a_1 \qquad \text{Equations 2-5}$$

$$c_2 = 1 + a_1 + a_1$$

$$d_1 = \frac{b_1}{b_0} - a_1$$

$$d_2 = \frac{b_1}{b_0} - a_1 + \frac{b_2}{b_0} - a_2$$

Biquad filter 900 also employs mixers 972, which may be implemented by a multiply accumulator. In operation, an input is received at the biquad filter 900. The input is forwarded toward the output via a mixer 982 and gain coefficient $b_0$ 973. The input is also forwarded toward previous state 971 block for storage in memory via another mixer 981. On a next cycle/state, the output of previous state block 971 is forwarded via gain coefficient $d_1$ 974 to a mixer 983, forwarded via gain coefficient $-c_1$ 975 to a mixer 984, and forwarded toward another previous state block 972 via a mixer 985. In another state, the output of previous state 972 is forwarded via gain coefficient $d_2$ 978 toward mixer 983. Mixer 983 mixes the output of previous state 972 and gain coefficient $d_2$ 978 and the output of previous state 971 and gain coefficient $d_1$ 974. The result is then forwarded for mixing with the input at mixer 982. Further, the output of previous state 972 is forwarded toward mixer 984 via gain coefficient $-c_2$ 976. Hence, the output of previous state 972 and gain coefficient $-c_2$ 976 are mixed with the output of previous state 971 and gain coefficient $-c_1$ 975. The results are then forwarded to mixer 981, which mixes the results from mixer 984 with the input for feedback into previous state 971. In addition, the biquad filter 900 employs a switch 977 which applies a gain of zero or a gain of one. When a gain of one is set, the switch 977 allows the output of previous state 972 to feed back into previous state 972 via mixer 985. The switch 977 may be set to zero and all coefficients change according to equation 1 to convert the biquad filter 900 into a so called direct form two biquad filter.

As can be seen, modified input at a first state is mixed with modified input of a second state, which is then mixed with input at a third state. Accordingly, input signal samples continually modify further input samples that are received later in time.

It should be noted that a source of error in a biquad filter is quantization. Quantization occurs when a signal sample is stored, for example at previous state 971 and/or 972. Specifically, quantization is a result of a rounding error when the memory employed to store the sample is not large enough to store the sample at perfect resolution. As noted above, biquads employ poles and zeros. A direct form biquad filter may attenuate the signal by applying zeros, store the signal causing quantization, and then amplify the signal by applying poles. This approach results in errors relating to quantization being amplified. To reach a reasonable signal to noise ratio (SNR), such direct form biquads typically use more bits than biquad filter 900. In contrast, biquad filter 900 amplifies the signal, stores and quantizes the signal, and then attenuates the signal. This approach results in the quantization error being attenuated instead of amplified. As a result, the biquad filter 900 may achieve sixty decibels (dB) lower SNR than a direct form biquad employing a similar number of bits in the previous state memory. Alternatively, for similar SNRs the biquad filter 900 can operate with about ten less bits in memory, which may be a substantial space savings.

The order of operations of the biquad filter 900 can be seen be review of the coefficients. Specifically, $b_0$ 973, $d_1$ 974, and $d_2$ 978 zeros and $-c_1$ 975, $-c_2$ 976 apply poles. As shown in FIG. 9, the signal always passes through amplifiers applying poles ($-c_1$ 975, $-c_2$ 976) before quantization by previous states 971 and 972. The output of such states is then either fed back into the system for use in later states or output via amplifiers applying zeros (e.g. $b_0$ 973, $d_1$ 974, and $d_2$ 978 zeros).

In other words, the biquad filter 900 employs poles to amplify portions of a sample of a noise/anti-noise signal. The biquad filter 900 also employs zeros to attenuate portions of the sample of the noise/anti-noise signal. Further, the biquad filter 900 employs a filter register to store a quantization of the sample of the noise/anti-noise signal. In addition, the biquad filter 900 is configured to amplify the sample, prior to quantizing the sample, and then attenuate the sample.

A goal of a biquad design may be to minimize requirements by reducing storage size and current while achieving a desired performance given an input signal type and target filters. As discussed above, the frequencies of interest for the biquad filters used herein are generally in the audio band (e.g. less than 20 kHz), which is significantly smaller than the sample rate (e.g. less an 1 MHz). Biquad filter 900 may significantly outperform biquad designs in this scenario (e.g. when center frequency is much less than sample rate). As an example, when operating at about 6.144 MHz to implement a peaking filter with 40 dB gain at 250 hertz(Hz) with quality factor (Q) of one, biquad filter 900 may generates about 60 dB lower noise than a direct form two biquad with the same number of bits. That may result in savings of about ten bits.

Another feature is that there biquad filter 900 may not require multipliers on the input signal directly. This yields a design that can be pipelined easily. Further, the multiplication by $b_0$ 973 is positioned at the very output. As such, the biquad filter 900 acts as a filter followed by final gain stage. This becomes convenient when multiple biquads are employed in series. In that case, the $b_0$ 973 multiplications can be combined into a signal multiplication step. So, for a cascade of N biquads, direct form biquads may require 5N multiplications. In contrast, biquad filter 900 only employs 4N+1 multiplications. Having a multiplier at the output of the series cascade may be particularly useful in RAP hardware architecture.

Figure 10:
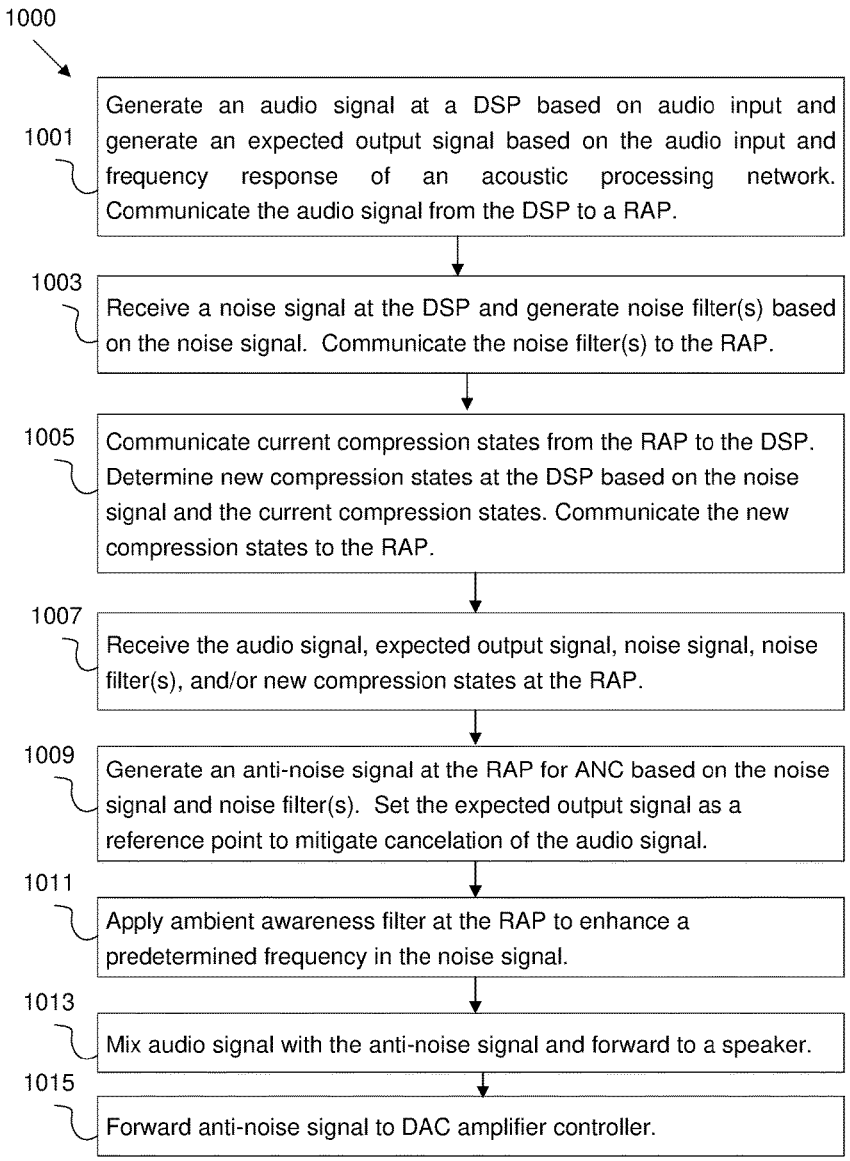
FIG. 10 is a flowchart of an example method of operating an acoustic processing network.

FIG. 10 is a flowchart of an example method 1000 of operating an acoustic processing network, such as network 100, 300, and/or 400 with a RAP with an I/O, such as RAP I/O 200 and an architecture such as RAP architecture 500 and/or 600 that employs topologies such as topology 700 and/or 800 with biquads such as biquad filter 900. In other words, method 1000 may be implemented by employing various combinations of the components shown in the various Figs. as discussed hereinabove.

At block 1001, an audio signal is generated at a DSP based on audio input. Further, an expected output signal is also generated at the DSP based on the audio input and a frequency response of an acoustic processing network. The audio signal and the expected output signal are then communicated from the DSP to the RAP as shown in network 400.

At block 1003, a noise signal is also received at the DSP. The noise signal is received from at least one microphone. The DSP generates a noise filter based on the noise signal. The DSP also communicates the noise filter from the DSP to a RAP as shown in network 100. As noted above, the DSP operates at a first frequency, while the RAP operates at a second frequency higher than the first frequency.

At block 1005, the RAP employs current compression states at the RAP to control an adjustable amplifier, for adjusting an anti-noise signal. The current compression states employed by the RAP are communicated from the RAP to the DSP as shown in network 300. The DSP then determines new compression states based on the noise signal and the current compression states. The DSP communicates the new compression states from to the RAP to support controlling the adjustable amplifier. Such compression states may include a peak signal estimate, an instantaneous gain, a target gain, an attack parameter, a release parameter, a peak decay parameter, a hold parameter, a RMS of the anti-noise signal or combinations thereof.

At block 1007, the RAP receives the audio signal, the expected output signal, noise filters, and/or new compression states from the DSP, as well as noise signal(s) from the microphone(s) (e.g. FF and/or FB).

At block 1009, the RAP generates an anti-noise signal based on the noise signal and the noise filter for use in ANC. Further, the RAP sets the expected output signal as a reference point when generating the anti-noise signal to mitigate cancellation of the audio signal by the anti-noise signal. The anti-noise signal may be generated at the RAP by configuring programmable biquad filters to implement the noise filter from the DSP. For example, the biquad filters may amplify a sample of the anti-noise signal, then quantize the sample of the anti-noise signal, and then attenuate the sample of the anti-noise filter as shown by biquad 900.

At block 1011, an ambient awareness filter is applied at the RAP to enhance a predetermined frequency band in the noise signal when generating the anti-noise signal as discussed with respect to topology 800. This may result in an enhanced predetermined frequency band, such as a frequency band associated with speech. Additional filters may also be applied to add in a side tone in some examples.

At block 1013, the RAP mixes the audio signal with the anti-noise signal. The RAP also forwards the resulting signal to a speaker for output to a user. Depending on the example, the resulting signal may include, audio, anti-noise, a side tone, an ambient awareness signal with an enhanced predetermined frequency band, and/or any other feature described herein.

At block 1015, the RAP also forwards the anti-noise signal to a DAC amplifier controller to support adjusting a DAC amplifier based on anti-noise signal level in order to mitigate clipping and other artifacts. It should be noted that the method 1000 discussed above attempts to describe simultaneous action of all features disclosed herein. Accordingly, method 1000 contains many optional steps as not all features need be active at all times. Further, method 1000 may operate constantly, and hence may not always operate in the order depicted.

Examples of the disclosure may operate on a particularly created hardware, on firmware, digital signal processors, or on a specially programmed general purpose computer including a processor operating according to programmed instructions. The terms "controller" or "processor" as used herein are intended to include microprocessors, microcomputers, Application Specific Integrated Circuits (ASICs), and dedicated hardware controllers. One or more aspects of the disclosure may be embodied in computer-usable data and computer-executable instructions (e.g. computer program products), such as in one or more program modules, executed by one or more processors (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as Random Access Memory (RAM), Read Only Memory (ROM), cache, Electrically Erasable Programmable Read-Only Memory (EEPROM), flash memory or other memory technology, Compact Disc Read Only Memory (CD-ROM), Digital Video Disc (DVD), or other optical disk storage, magnetic cassettes, magnetic tape, magnetic disk storage or other magnetic storage devices, and any other volatile or nonvolatile, removable or non-removable media implemented in any technology. Computer readable media excludes signals per se and transitory forms of signal transmission. In addition, the functionality may be embodied in whole or in part in firmware or hardware equivalents such as integrated circuits, field programmable gate arrays (FPGA), and the like. Particular data structures may be used to more effectively implement one or more aspects of the disclosure, and such data structures are contemplated within the scope of computer executable instructions and computer-usable data described herein.

Aspects of the present disclosure operate with various modifications and in alternative forms. Specific aspects have been shown by way of example in the drawings and are described in detail herein below. However, it should be noted that the examples disclosed herein are presented for the purposes of clarity of discussion and are not intended to limit the scope of the general concepts disclosed to the specific examples described herein unless expressly limited. As such, the present disclosure is intended to cover all modifications, equivalents, and alternatives of the described aspects in light of the attached drawings and claims.

References in the specification to embodiment, aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

EXAMPLES

Illustrative examples of the technologies disclosed herein are provided below. An embodiment of the technologies may include any one or more, and any combination of, the examples described below.

Example 1 includes an acoustic processing network comprising: a Digital Signal Processor (DSP) operating at a first frequency, the DSP to: receive a noise signal from at least one microphone, and generate a noise filter based on the noise signal; and a Real-Time Acoustic Processor (RAP) operating at a second frequency higher than the first frequency, the RAP to: receive the noise signal from the microphone, receive the noise filter from the DSP, and generate an anti-noise signal based on the noise signal and the noise filter for use in Active Noise Cancellation (ANC).

Example 2 includes the acoustic processing network of Example 1, wherein the RAP includes: an adjustable amplifier to amplify the anti-noise signal, and a compressor circuit to control the adjustable amplifier to mitigate artifacts in the anti-noise signal.

Example 3 includes the acoustic processing network of Example 2, wherein the RAP further includes a compression state register to store compression states, the compressor circuit further to control the adjustable amplifier based on the compression states.

Example 4 includes the acoustic processing network of Example 3, wherein the compression states include a peak signal estimate, an instantaneous gain, a target gain, an attack parameter, a release parameter, a decay parameter, a hold parameter, or combinations thereof.

Example 5 includes the acoustic processing network of Example 3, wherein the compression states include a Root Mean Square (RMS) of the anti-noise signal.

Example 6 includes the acoustic processing network of Examples 1-4, wherein the DSP is further to: receive current compression states from the RAP, determine new compression states based on the noise signal and the current compression states, and forward the new compression states to the RAP to support controlling the adjustable amplifier.

Example 7 includes the acoustic processing network of Examples 1-6, wherein the RAP includes one or more programmable biquad filters to implement the noise filter from the DSP and generate the anti-noise signal.

Example 8 includes the acoustic processing network of Example 7, wherein the biquad filters employ one or more poles to amplify portions of a sample of the anti-noise signal, one or more zeros to attenuate portions of the sample of the anti-noise signal, and a filter register to store a quantization of the sample of the anti-noise signal, the biquad filters to amplify the sample prior to quantizing the sample and then attenuate the sample.

Example 9 includes the acoustic processing network of Examples 1-8, wherein the microphone is a feed forward microphone, and the RAP is further to: apply an ambient awareness filter to enhance a predetermined frequency band in the noise signal when generating the anti-noise signal, resulting in an enhanced predetermined frequency band, and forward the anti-noise signal with the enhanced predetermined frequency band to a speaker for output to a user.

Example 10 includes the acoustic processing network of Examples 1-9, wherein a latency between receiving a noise signal sample from ae microphone and forwarding a corresponding anti-noise signal sample to a speaker is less than one hundred microseconds.

Example 11 includes the acoustic processing network of Examples 1-10, wherein the DSP is further to: generate an audio signal based on audio input, and generate an expected output signal based on the audio input and a frequency response of the acoustic processing network, and wherein the RAP is further to: receive the audio signal from the DSP, mix the audio signal with the anti-noise signal, and set the expected output signal as a reference point when generating the anti-noise signal to mitigate cancellation of the audio signal by the anti-noise signal.

Example 12 includes the acoustic processing network of Examples 1-11, wherein the RAP is further configured to forward the anti-noise signal to a digital to analog converter (DAC) amplifier controller to support adjusting a DAC amplifier based on anti-noise signal level.

Example 13 includes a method comprising: receive a noise signal at a Digital Signal Processor (DSP) operating at a first frequency, the noise signal received from at least one microphone; generating a noise filter at the DSP based on the noise signal; communicate the noise filter from the DSP to a Real-Time Acoustic Processor (RAP) operating at a second frequency higher than the first frequency; receive the noise signal from the microphone at the RAP; generate an anti-noise signal at the RAP based on the noise signal and the noise filter for use in Active Noise Cancellation (ANC).

Example 14 includes the method of Example 13, further comprising employing current compression states at the RAP to control an adjustable amplifier to adjust the anti-noise signal; communicating the current compression states from the RAP to the DSP; determining new compression states at the DSP based on the noise signal and the current compression states, and communicating the new compression states from the DSP to the RAP to support controlling the adjustable amplifier.

Example 15 includes the method of Example 14, wherein the compression states include a peak signal estimate, an instantaneous gain, a target gain, a Root Mean Square (RMS) of the anti-noise signal or combinations thereof.

Example 16 includes the method of Examples 13-15, wherein the anti-noise signal is generated at the RAP by configuring one or more programmable biquad filters to implement the noise filter from the DSP.

Example 17 includes the method of Example 16, wherein the biquad filters amplify a sample of the anti-noise signal, then quantize the sample of the anti-noise signal, and then attenuate the sample of the anti-noise filter.

Example 18 includes the method of Examples 13-17, further comprising: applying an ambient awareness filter at the RAP to enhance a predetermined frequency band in the noise signal when generating the anti-noise signal, resulting in an enhanced predetermined frequency band, and forwarding the anti-noise signal with the enhanced predetermined frequency band to a speaker for output to a user.

Example 19 includes the method of Examples 13-18, further comprising: generating an audio signal at the DSP based on audio input; generating an expected output signal at the DSP based on the audio input and a frequency response of an acoustic processing network; communicating the audio signal from the DSP to the RAP; mixing the audio signal with the anti-noise signal at the RAP; and setting the expected output signal as a reference point when generating the anti-noise signal to mitigate cancellation of the audio signal by the anti-noise signal.

Example 20 includes the method of Examples 13-19, further comprising forwarding the anti-noise signal to a digital to analog converter (DAC) amplifier controller to support adjusting a DAC amplifier based on anti-noise signal level.

The previously described examples of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. Where a particular feature is disclosed in the context of a particular aspect or example, that feature can also be used, to the extent possible, in the context of other aspects and examples.

Also, when reference is made in this application to a method having two or more defined steps or operations, the defined steps or operations can be carried out in any order or simultaneously, unless the context excludes those possibilities.

Although specific examples of the disclosure have been illustrated and described for purposes of illustration, it will be understood that various modifications may be made without departing from the spirit and scope of the disclosure. Accordingly, the disclosure should not be limited except as by the appended claims.

I claim:

1. An acoustic processing network, comprising:

a digital signal processor operating at a first frequency, the digital signal processor configured to receive a noise signal from one or more microphones, at least one microphone being a feed forward microphone, and generate a noise filter based on the noise signal; and a real-time acoustic processor operating at a second frequency higher than the first frequency, the real-time acoustic processor configured to receive the noise signal from the one or more microphones, receive the noise filter from the digital signal processor, generate an anti-noise signal based on the noise signal and the noise filter for use in active noise cancellation, apply an ambient awareness filter to enhance a predetermined frequency band in the noise signal when generating the anti-noise signal, resulting in an enhanced predetermined frequency band, and forward the anti-noise signal with the enhanced predetermined frequency band to a speaker for output to a user.

2. The acoustic processing network of claim 1 wherein the real-time acoustic processor includes:

an adjustable amplifier to amplify the anti-noise signal, and a compressor circuit to control the adjustable amplifier to mitigate artifacts in the anti-noise signal.

3. The acoustic processing network of claim 2 wherein the real-time acoustic processor further includes a compression state register to store compression states, the compressor circuit further configured to control the adjustable amplifier based on the compression states.

4. The acoustic processing network of claim 3 wherein the compression states include a peak signal estimate, an instantaneous gain, a target gain, an attack parameter, a release parameter, a decay parameter, a hold parameter, or combinations thereof.

5. The acoustic processing network of claim 3 wherein the compression states include a root mean square of the anti-noise signal.

6. The acoustic processing network of claim 2 wherein the digital signal processor is further configured to:

receive current compression states from the real-time acoustic processor, determine new compression states based on the noise signal and the current compression states, and forward the new compression states to the real-time acoustic processor to support controlling the adjustable amplifier.

7. The acoustic processing network of claim 1 wherein the real-time acoustic processor includes one or more programmable biquad filters to implement the noise filter from the digital signal processor and generate the anti-noise signal.

8. The acoustic processing network of claim 7 wherein the biquad filters employ one or more poles to amplify portions of a sample of the anti-noise signal, one or more zeros to attenuate portions of the sample of the anti-noise signal, and a filter register to store a quantization of the sample of the anti-noise signal, the biquad filters configured to amplify the sample prior to quantizing the sample and then attenuate the sample.

9. The acoustic processing network of claim 1 wherein a latency between receiving a noise signal sample from the one or more microphones and forwarding a corresponding anti-noise signal sample to the speaker is less than one hundred microseconds.

10. The acoustic processing network of claim 1 wherein the DSP is further configured to:

generate an audio signal based on audio input, and generate an expected output signal based on the audio input and a frequency response of the acoustic processing network, and wherein the real-time acoustic processor is further to:

receive the audio signal from the digital signal processor, mix the audio signal with the anti-noise signal, and set the expected output signal as a reference point when generating the anti-noise signal to mitigate cancellation of the audio signal by the anti-noise signal.

11. The acoustic processing network of claim 1 wherein the real-time acoustic processor is further configured to forward the anti-noise signal to a digital to analog converter amplifier controller to support adjusting a digital to analog converter amplifier based on anti-noise signal level.

12. A method for real-time acoustic processing, comprising:

receiving a noise signal at a digital signal processor operating at a first frequency, the noise signal received from at least one microphone;

generating a noise filter at the digital signal processor based on the noise signal;

communicating the noise filter from the digital signal processor to a Real-Time Acoustic Processor operating at a second frequency higher than the first frequency;

receiving the noise signal from the microphone at the real-time acoustic processor;

generating an anti-noise signal at the real-time acoustic processor based on the noise signal and the noise filter for use in Active Noise Cancellation;

applying an ambient awareness filter at the real-time acoustic processor to enhance a predetermined frequency band in the noise signal when generating the anti-noise signal, resulting in an enhanced predetermined frequency band; and forwarding the anti-noise signal with the enhanced predetermined frequency band to a speaker for output to a user.

13. The method of claim 12 further comprising:

employing current compression states at the real-time acoustic processor to control an adjustable amplifier to adjust the anti-noise signal;

communicating the current compression states from the real-time acoustic processor to the digital signal processor;

determining new compression states at the digital signal processor based on the noise signal and the current compression states, and communicating the new compression states from the digital signal processor to the real-time acoustic processor to support controlling the adjustable amplifier.

14. The method of claim 13 wherein the current compression states and the new compression states include a peak signal estimate, an instantaneous gain, a target gain, a root mean square of the anti-noise signal or combinations thereof.

15. The method of claim 12 wherein the anti-noise signal is generated at the real-time acoustic processor by configuring one or more programmable biquad filters to implement the noise filter from the digital signal processor.

16. The method of claim 15 wherein the biquad filters are further configured to amplify a sample of the anti-noise signal, quantize the sample of the anti-noise signal, and attenuate the sample of the anti-noise signal.

17. The method of claim 12 further comprising forwarding the anti-noise signal to a digital to analog converter amplifier controller to support adjusting a digital to analog converter amplifier based on anti-noise signal level.

18. A method for real-time acoustic processing, comprising:

receiving a noise signal at a digital signal processor operating at a first frequency, the noise signal received from at least one microphone;

generating a noise filter at the digital signal processor based on the noise signal;

communicating the noise filter from the digital signal processor to a Real-Time Acoustic Processor operating at a second frequency higher than the first frequency;

receiving the noise signal from the microphone at the real-time acoustic processor;

generating an anti-noise signal at the real-time acoustic processor based on the noise signal and the noise filter for use in active noise cancellation;

generating an audio signal at the digital signal processor based on audio input;

generating an expected output signal at the digital signal processor based on the audio input and a frequency response of an acoustic processing network;

communicating the audio signal from the digital signal processor to the real-time acoustic processor;

mixing the audio signal with the anti-noise signal at the real-time acoustic processor; and setting the expected output signal as a reference point when generating the anti-noise signal to mitigate cancellation of the audio signal by the anti-noise signal.

* * * * *